US011738255B2

(12) United States Patent
Greene

(10) Patent No.: US 11,738,255 B2
(45) Date of Patent: Aug. 29, 2023

(54) AUTOMATED CARD DEALER ASSEMBLY

(71) Applicant: Anthony Greene, Compton, CA (US)

(72) Inventor: Anthony Greene, Compton, CA (US)

( * ) Notice: Subject to any disclaimer, the term of this patent is extended or adjusted under 35 U.S.C. 154(b) by 169 days.

(21) Appl. No.: 17/344,845

(22) Filed: Jun. 10, 2021

(65) Prior Publication Data

US 2022/0395743 A1 Dec. 15, 2022

(51) Int. Cl.

| | |
|---|---|
| ***A63F 1/14*** | (2006.01) |
| ***A63F 1/12*** | (2006.01) |
| ***A63F 1/06*** | (2006.01) |
| ***A63F 1/00*** | (2006.01) |

(52) U.S. Cl.

CPC ..... *A63F 1/14* (2013.01); *A63F 1/12* (2013.01); *A63F 1/067* (2013.01); *A63F 2001/005* (2013.01)

(58) Field of Classification Search

CPC .... A63F 1/14; A63F 1/12; A63F 1/067; A63F 2001/005; A63F 2250/1021

See application file for complete search history.

(56) References Cited

U.S. PATENT DOCUMENTS

| | | | | |
|---|---|---|---|---|
| 3,666,270 | A * | 5/1972 | Mazur | A63F 1/14 273/149 R |
| 6,361,044 | B1 * | 3/2002 | Block | A63F 1/14 273/149 P |
| 7,367,563 | B2 | 5/2008 | Yoseloff | |
| 8,968,079 | B2 | 3/2015 | Kennedy | |
| 9,202,171 | B2 | 12/2015 | Kuhn | |
| 10,709,962 | B1 | 7/2020 | Riordan | |
| 2005/0017451 | A1 | 1/2005 | Ollington | |
| 2005/0164759 | A1 | 7/2005 | Smith | |
| 2006/0108736 | A1 * | 5/2006 | Walker | G07F 17/3293 463/16 |
| 2007/0090595 | A1 * | 4/2007 | Csikos | A63F 1/06 273/274 |
| 2008/0214262 | A1 | 9/2008 | Phillips | |
| 2010/0320684 | A1 * | 12/2010 | Mali | A63F 1/14 273/149 R |
| 2015/0035230 | A1 * | 2/2015 | van Rossen | A63F 1/14 273/149 R |
| 2015/0375096 | A1 * | 12/2015 | Jackson | G07F 17/32 463/11 |
| 2019/0021489 | A1 * | 1/2019 | Morag | A47B 25/00 |
| 2019/0099661 | A1 | 4/2019 | LaDuca | |

FOREIGN PATENT DOCUMENTS

| | | |
|---|---|---|
| WO | WO2005072247 | 8/2005 |
| WO | WO2020081699 | 4/2020 |

* cited by examiner

*Primary Examiner* — Michael D Dennis

(57) ABSTRACT

An automated card dealer assembly includes a gaming table that has a plurality of chairs is positioned around the gaming table for having a player sit on the chairs. Each of the chairs is assigned a respective one of a plurality of gaming spots at the gaming table. A card dealing unit is positioned on the gaming table and the card dealing unit contains at least one deck of playing cards. The card dealing unit has a dealing chute that is movably integrated into the card dealing unit. The card dealing unit is in communication with each of the weight sensors and the card dealing unit deals a predetermined number of playing cards outwardly from the dealing chute. Additionally, the dealing chute is actuated to deal the predetermined number of playing cards toward each chair to deal playing cards to each player.

7 Claims, 3 Drawing Sheets

AUTOMATED CARD DEALER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to card dealer devices and more particularly pertains to a new card dealer device for automatically dealing cards at a gaming table. The device includes a gaming table, weight sensors integrated into chairs at the gaming table and a card dealing unit that deals a predetermined number of playing cards toward gaming chairs in which a player is seated.

(2) Description of Related Art Including Information Disclosed Under 37 CFR 1.97 and 1.98

The prior art relates to card dealer devices including a variety of electronic card gaming tables that include touch screens for playing a virtual hand of cards. The prior art discloses a novel card gaming table which includes indicia related to each player and a plurality of playing cards that have corresponding indicia. The prior art discloses a variety of automated gaming tables that each has an upright video display for displaying a virtual dealer and a plurality of gaming spots at a gaming table. The prior art discloses an automated gaming table that includes a radial dealing arm that automatically deals cards to players at the automated gaming table. In no instance does the prior art discloses a gaming table with weight sensors in chairs to detect players seated in the chairs and a card dealing unit that deals playing cards to chairs in which a player is seated.

BRIEF SUMMARY OF THE INVENTION

An embodiment of the disclosure meets the needs presented above by generally comprising a gaming table that has a plurality of chairs is positioned around the gaming table for having a player sit on the chairs. Each of the chairs is assigned a respective one of a plurality of gaming spots at the gaming table. A card dealing unit is positioned on the gaming table and the card dealing unit contains at least one deck of playing cards. The card dealing unit has a dealing chute that is movably integrated into the card dealing unit. The card dealing unit is in communication with each of the weight sensors and the card dealing unit deals a predetermined number of playing cards outwardly from the dealing chute. Additionally, the dealing chute is actuated to deal the predetermined number of playing cards toward each chair to deal playing cards to each player.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
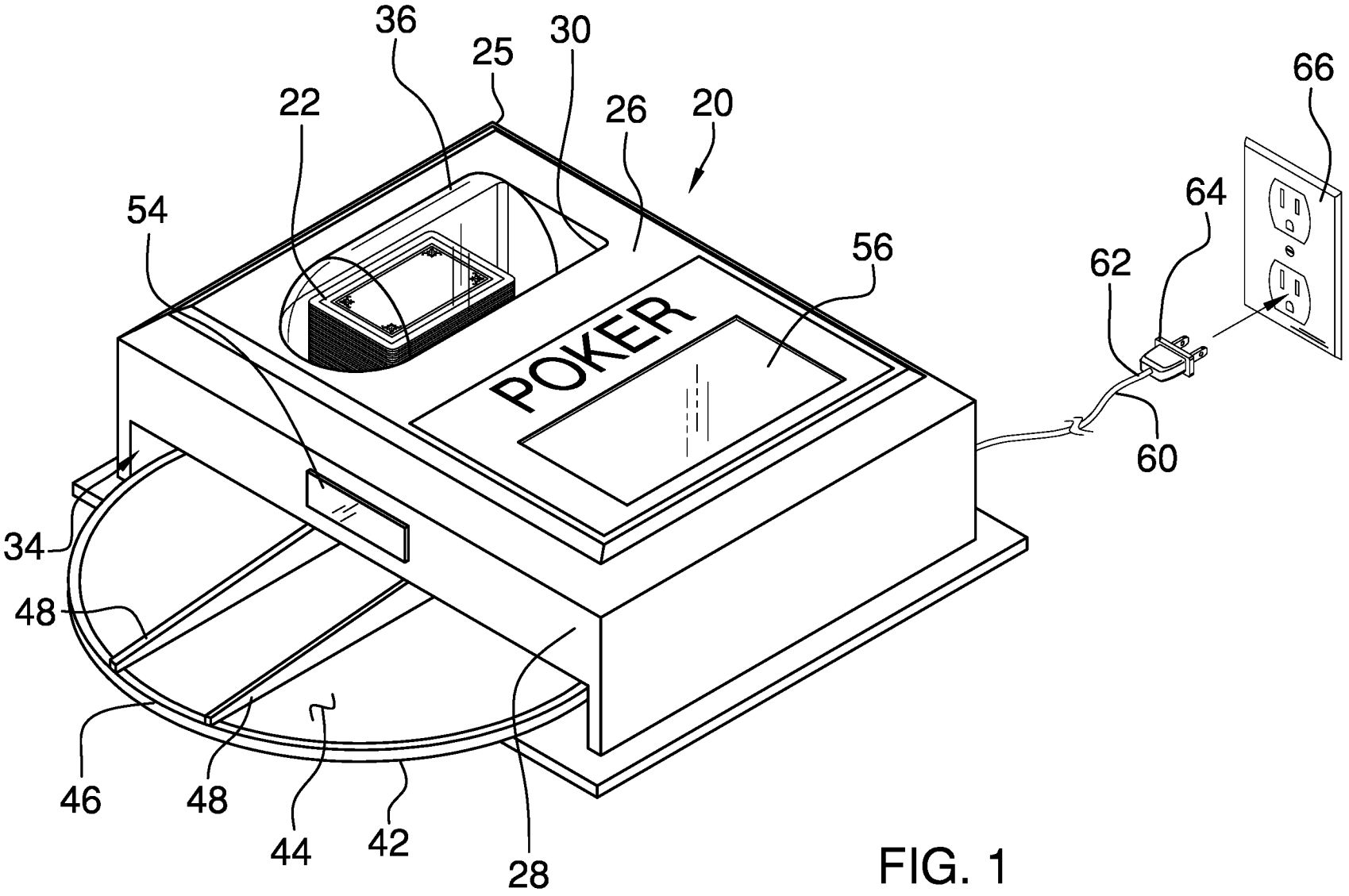
FIG. 1 is a perspective view of a card dealing unit of an automated card dealer assembly according to an embodiment of the disclosure.
Figure 2:
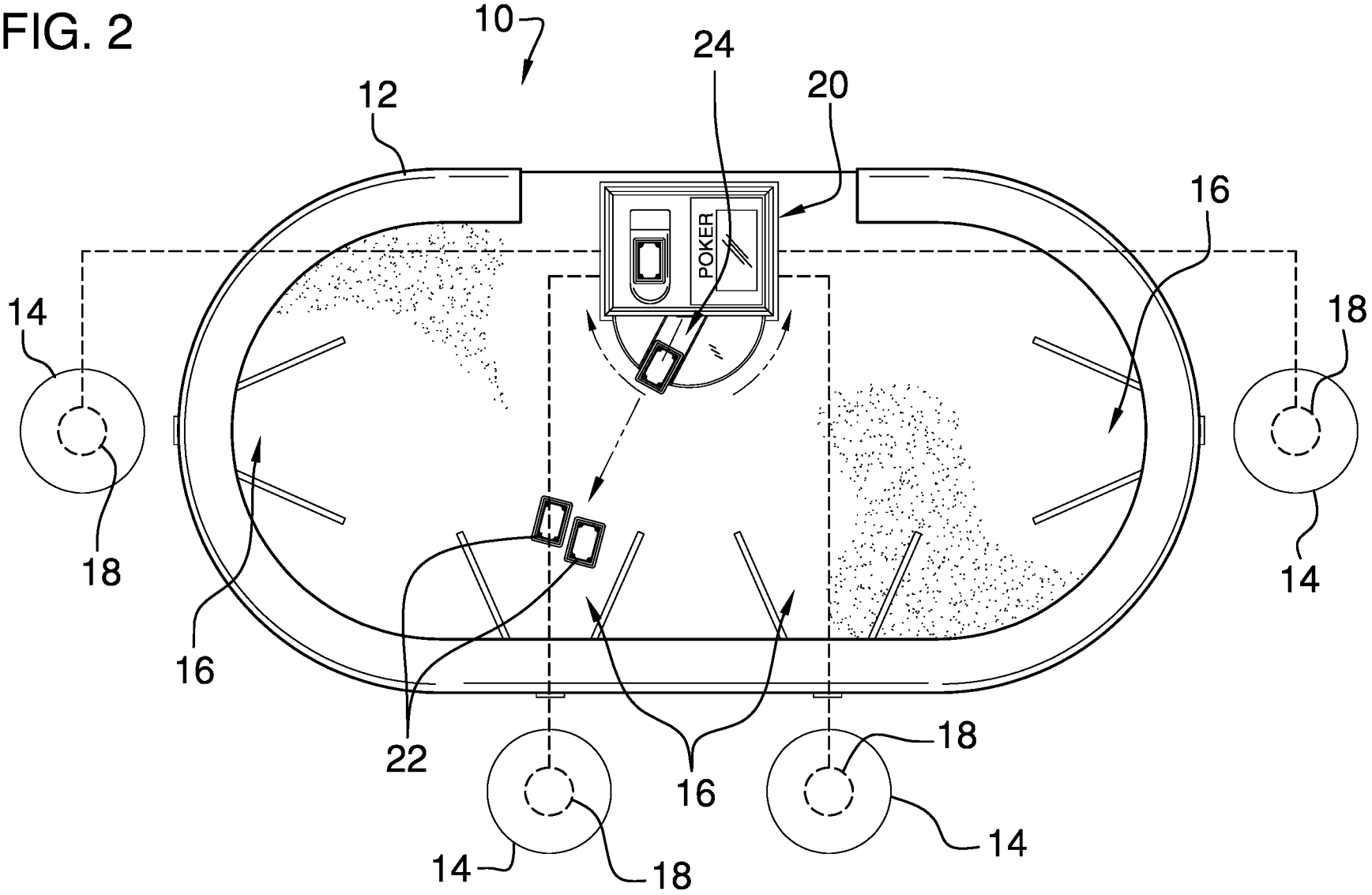
FIG. 2 is a top view of an embodiment of the disclosure.
Figure 3:
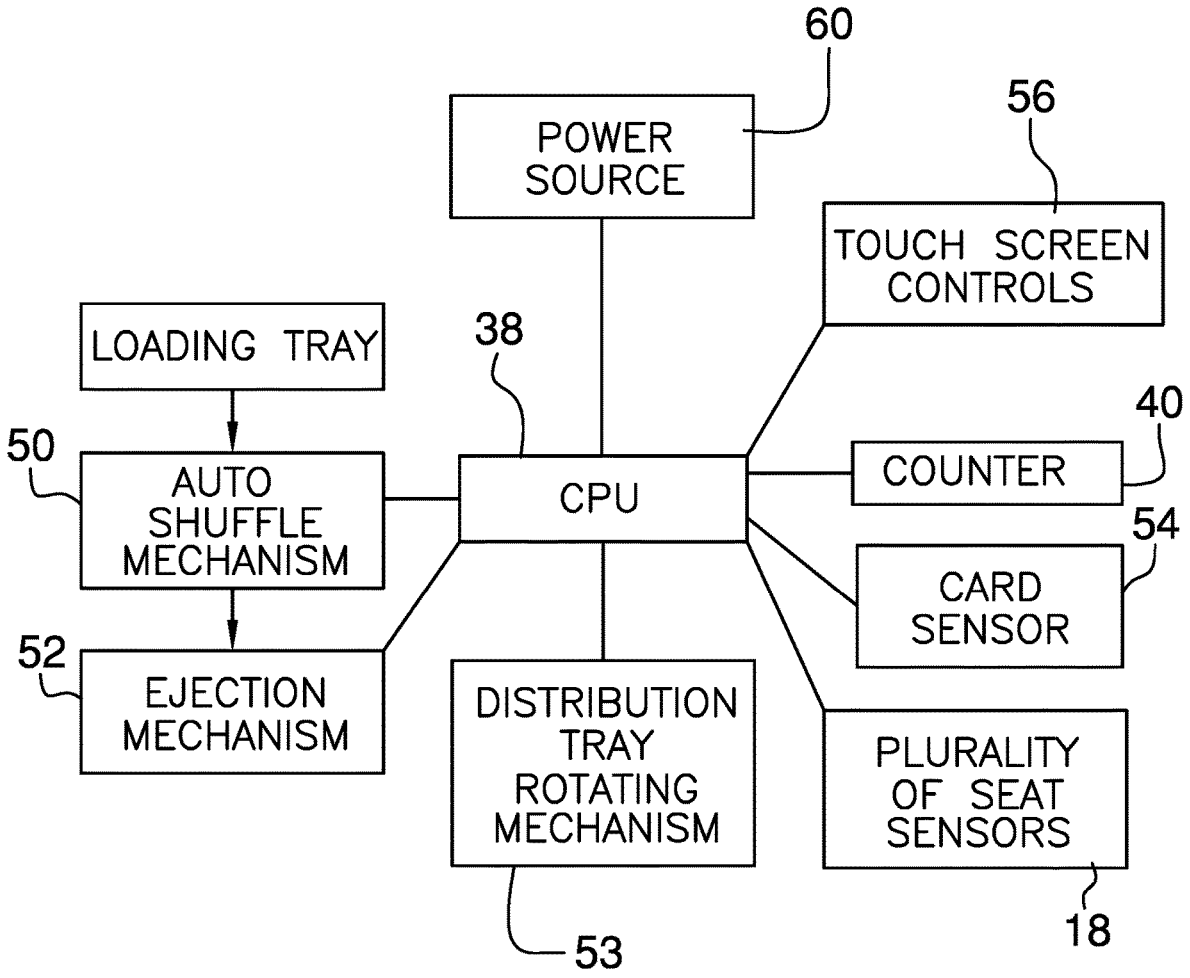
FIG. 3 is a schematic view of an embodiment of the disclosure.

With reference now to the drawings, and in particular to FIGS. 1 through 3 thereof, a new card dealer device embodying the principles and concepts of an embodiment of the disclosure and generally designated by the reference numeral 10 will be described.

As best illustrated in FIGS. 1 through 3, the automated card dealer assembly 10 generally comprises a gaming table 12 that has a plurality of chairs 14 positioned around the gaming table 12 and each of the chairs 14 can have a player sit on the chairs 14. Additionally, each of the chairs 14 is assigned a respective one of a plurality of gaming spots 16 at the gaming table 12. The gaming table 12 may be a poker table in a casino, for example, or other type of gaming table that is employed for playing card games. A plurality of weight sensors 18 is each integrated into a respective one of the chairs 14 to sense the weight of the player when the player sits in one of the chairs 14. Each of the weight sensors 18 may comprise an electronic weight sensor or the like and each of the weight sensors 18 may have a trigger weight of at least 30.0 pounds.

A card dealing unit 20 is positioned on the gaming table 12 and the card dealing unit 20 contains at least one deck of playing cards 22. The card dealing unit 20 has a dealing chute 24 that is movably integrated into the card dealing unit 20 and the card dealing unit 20 is in communication with each of the weight sensors 18. The card dealing unit 20 deals a predetermined number of playing cards 22 outwardly from the dealing chute 24 and the dealing chute 24 is actuated to deal the predetermined number of playing cards 22 toward each chair in which the weight sensor senses the weight of a player. In this way the card dealing unit 20 can deal playing cards 22 to each player. Thus, the players can be dealt cards without the need to have a dealer or other person present at the gaming table 12.

The card dealing unit 20 comprises a housing 25 that has a top wall 26 and a front wall 28, and the housing 25 has a card compartment 30 integrated into an interior of the housing 25 to house a deck of playing cards 22. The top wall 26 has an opening 32 extending into the card compartment 30 and the front wall 28 has a dispensing opening 34 extending into the interior of the housing 25. A dome 36 is positioned over the opening 32 in the top wall 26 and the dome 36 is comprised of a translucent material to facilitate the deck of playing cards 22 to be visible through the dome 36. The card dealing unit 20 includes a control circuit 38 that is positioned in the housing 25 and the control circuit 38 is electrically coupled to each of the weight sensors 18. In this way the control circuit 38 can determine which of the chairs 14 seats a player. Additionally, the control circuit 38 includes a card counter 40.

The card dealing unit 20 includes a dealing disk 42 that has a top surface 44 and a perimeter edge 46. The dealing disk 42 is rotatably positioned in the housing 25 having the dealing disk 42 extending outwardly through the dispensing opening 34 in the front wall 28 of the housing 25. Additionally, the dealing disk 42 has a pair of ridges 48 extending upwardly from the top surface 44, and the ridges 48 are oriented parallel to each other such that each of the ridges 48 defines the dealing chute 24. Each of the ridges 48 extends from a center of the dealing disk 42 to the perimeter edge 46 of the dealing disk 42, and each of the ridges 48 has a decreasing height between the center of the dealing disk 42 and the perimeter edge 46.

The card dealing unit 20 includes a card shuffler 50 that is integrated into the housing 25. The card shuffler 50 is aligned with the card compartment 30 to facilitate the card shuffler 50 to automatically shuffle the deck of playing cards 22. The card shuffler 50 is electrically coupled to the control circuit 38 and the card shuffler 50 may comprise an electronic card shuffler of any conventional design that would commonly be found in a casino or the like. The card dealing unit 20 includes a card ejector 52 that is integrated into the housing 25. The card ejector 52 is positioned to extend between the card compartment 30 and the dealing disk 42 to direct a predetermined number of cards onto the dealing disk 42 and subsequently onto the gaming table 12. The dealing disk 42 is actuated to be directed toward a respective one of the gaming spots 16 wherein the dealing disk 42 is configured to direct the playing cards 22 ejected by the card ejector 52 toward a respective player. The card ejector 52 includes a rotating mechanism 53, such as an electric motor or the like, that is coupled to the dealing disk 42 thereby facilitating the dealing disk 42 to be rotated for directing the dealing chute 24 toward each of the gaming spots 16.

The card dealing unit 20 includes a card sensor 54 that is positioned on the front wall 28 of the housing 25. The card sensor 54 is positioned over the dealing disk 42 to sense the playing cards 22 as they are ejected outwardly from the housing 25. The card sensor 54 is electrically coupled to the control circuit 38. The card counter 40 in the control circuit 38 counts each time the card sensor 54 senses a playing card 22 to determine when all of the playing cards 22 have been dealt. The card sensor 54 may be an optical sensor, a motion sensor or any other type of electronic sensor that is capable of detecting the playing cards 22 as the playing cards 22 are ejected from the dealing disk 42. The card dealing unit 20 includes a touch screen 56 that is coupled to the top wall 26 of the housing 25 such that the touch screen 56 is accessible to a user. The touch screen 56 is electrically coupled to the control circuit 38 and the touch screen 56 displays indicia 58 comprising menu options to facilitate a user to control operational parameters of the card dealing unit 20. The touch screen 56 may comprise a liquid crystal display or other type of electronic touch screen that can display indicia.

The card dealing unit 20 includes power cord 60 that is coupled to and extends away from the housing 25. The power cord 60 is electrically coupled to the control circuit 38, the power cord 60 has a distal end 62 with respect to the housing 25 and a power plug 64 is electrically coupled to the distal end 62. The power plug 64 can be plugged into a power source 66 comprising a female electrical outlet for powering the card dealing unit 20. The card dealing unit 20 may include a cash out mechanism that can pay out bets for the players when the players are gambling. The cash out mechanism may include a cash dispenser, a credit card reader and any other types of mechanisms associated with collecting and dispensing currency.

In use, the touch screen 56 is manipulated to program the operational parameters of the card dealing unit 20, including but not being limited to, the type of card game to be played and the number of decks of cards placed into the card compartment 30. The card dealing unit 20 deals a predetermined number of cards to each of gaming spots 16 in which the associated weight sensor senses that a player is sitting in the chair assigned to the gaming spots 16. In this way the card dealing unit 20 can automatically deal the predetermined number of cards to the players. The card dealing unit 20 facilitates a casino to be operated with a minimum number of employees assigned to the gaming table 12 for adhering to social distancing and other preventative guidelines during a pandemic.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automated card dealer assembly for dealing cards at a casino table, said assembly comprising:

a gaming table having a plurality of chairs being positioned around said gaming table wherein each of said chairs is configured to have a player sit on said chairs, each of said chairs being assigned a respective one of a plurality of gaming spots at said gaming table;

a plurality of weight sensors, each of said weight sensors being integrated into a respective one of said chairs wherein each of said weight sensors is configured to sense the weight of the player when the player sits in one of said chairs;

a card dealing unit being positioned on said gaming table, said card dealing unit containing at least one deck of playing cards, said card dealing unit having a dealing chute being movably integrated into said card dealing unit, said card dealing unit being in communication with each of said weight sensors, said card dealing unit dealing a predetermined number of playing cards outwardly from said dealing chute, said dealing chute being actuated to deal the predetermined number of playing cards toward each chair in which said weight sensor senses the weight of a player wherein said card dealing unit is configured to deal playing cards to each player; and wherein said card dealing unit comprises:

a housing having a top wall and a front wall, said housing having a card compartment being integrated into an interior of said housing wherein said card compartment is configured to house a deck of playing cards, said top wall having an opening extending into said card compartment, said front wall having a dispensing opening extending into said interior of said housing; and a dealing disk having a top surface and a perimeter edge, said dealing disk being rotatably positioned in said housing having said dealing disk extending outwardly through said dispensing opening in said front wall of said housing, said dealing disk having a pair of ridges extending upwardly from said top surface, said ridges being oriented parallel to each other such that each of said ridges defines said dealing chute, each of said ridges extending from a center of said dealing disk to said perimeter edge of said dealing disk, each of said ridges having a decreasing height between said center of said dealing disk and said perimeter edge.

2. The assembly according to claim 1, wherein said card dealing unit includes a control circuit being positioned in said housing, said control circuit being electrically coupled to each of said weight sensors wherein said control circuit is configured to determine which of said chairs seats a player, said control circuit including a card counter.

3. The assembly according to claim 2, wherein said card dealing unit includes a card shuffler being integrated into said housing, said card shuffler being aligned with said card compartment wherein said card shuffler is configured to automatically shuffle the deck of playing cards, said card shuffler being electrically coupled to said control circuit.

4. The assembly according to claim 2, wherein said card dealing unit includes a card ejector being integrated into said housing, said card ejector being positioned to extend between said card compartment and said dealing disk wherein said card ejector is configured to direct a predetermined number of cards onto said dealing disk and onto said gaming table, said dealing disk being actuated to be directed toward a respective one of said gaming spots wherein said dealing disk is configured to direct the playing cards ejected by said card ejector toward a respective player.

5. The assembly according to claim 2, wherein said card dealing unit includes a card sensor being positioned on said front wall of said housing, said card sensor being positioned over said dealing disk wherein said card sensor is configured to sense the playing cards as they are ejected outwardly from said housing, said card sensor being electrically coupled to said control circuit, said card counter in said control circuit counting each time said card sensor senses a playing card wherein said control circuit is configured to determine when all of the playing cards have been dealt.

6. The assembly according to claim 2, wherein said card dealing unit includes a touch screen being coupled to said top wall of said housing wherein said touch screen is configured to be accessible to a user, said touch screen being electrically coupled to said control circuit, said touch screen displaying indicia comprising menu options wherein said touch screen is configured to facilitate a user to control operational parameters of said card dealing unit.

7. An automated card dealer assembly for dealing cards at a casino table, said assembly comprising:

a gaming table having a plurality of chairs being positioned around said gaming table wherein each of said chairs is configured to have a player sit on said chairs, each of said chairs being assigned a respective one of a plurality of gaming spots at said gaming table;

a plurality of weight sensors, each of said weight sensors being integrated into a respective one of said chairs wherein each of said weight sensors is configured to sense the weight of the player when the player sits in one of said chairs;

a card dealing unit being positioned on said gaming table, said card dealing unit containing at least one deck of playing cards, said card dealing unit having a dealing chute being movably integrated into said card dealing unit, said card dealing unit being in communication with each of said weight sensors, said card dealing unit dealing a predetermined number of playing cards outwardly from said dealing chute, said dealing chute being actuated to deal the predetermined number of playing cards toward each chair in which said weight sensor senses the weight of a player wherein said card dealing unit is configured to deal playing cards to each player, said card dealing unit comprising:

a housing having a top wall and a front wall, said housing having a card compartment being integrated into an interior of said housing wherein said card compartment is configured to house a deck of playing cards, said top wall having an opening extending into said card compartment, said front wall having a dispensing opening extending into said interior of said housing;

a control circuit being positioned in said housing, said control circuit being electrically coupled to each of said weight sensors wherein said control circuit is configured to determine which of said chairs seats a player, said control circuit including a card counter;

a dealing disk having a top surface and a perimeter edge, said dealing disk being rotatably positioned in said housing having said dealing disk extending outwardly through said dispensing opening in said front wall of said housing, said dealing disk having a pair of ridges extending upwardly from said top surface, said ridges being oriented parallel to each other such that each of said ridges defines said dealing chute, each of said ridges extending from a center of said dealing disk to said perimeter edge of said dealing disk, each of said ridges having a decreasing height between said center of said dealing disk and said perimeter edge;

a card shuffler being integrated into said housing, said card shuffler being aligned with said card compartment wherein said card shuffler is configured to automatically shuffle the deck of playing cards, said card shuffler being electrically coupled to said control circuit;

a card ejector being integrated into said housing, said card ejector being positioned to extend between said card compartment and said dealing disk wherein said card ejector is configured to direct a predetermined number of cards onto said dealing disk and onto said gaming table, said dealing disk being actuated to be directed toward a respective one of said gaming spots wherein said dealing disk is configured to direct the playing cards ejected by said card ejector toward a respective player;

a card sensor being positioned on said front wall of said housing, said card sensor being positioned over said dealing disk wherein said card sensor is configured to sense the playing cards as they are ejected outwardly from said housing, said card sensor being electrically coupled to said control circuit, said card counter in said control circuit counting each time said card sensor senses a playing card wherein said control circuit is configured to determine when all of the playing cards have been dealt;

a touch screen being coupled to said top wall of said housing wherein said touch screen is configured to be accessible to a user, said touch screen being electrically coupled to said control circuit, said touch screen displaying indicia comprising menu options wherein said touch screen is configured to facilitate a user to control operational parameters of said card dealing unit; and a power cord being coupled to and extending away from said housing, said power cord being electrically coupled to said control circuit, said power cord having a distal end with respect to said housing, said distal end having a power plug being electrically coupled thereto wherein said power plug is configured to be plugged into a power source comprising a female electrical outlet.

* * * * *